US006318718B1

(12) United States Patent
Ogata et al.

(10) Patent No.: US 6,318,718 B1
(45) Date of Patent: Nov. 20, 2001

(54) IMAGE FORMING APPARATUS AND SHEET STACKING DEVICE WITH LIFTER

(75) Inventors: Atsushi Ogata, Sunto-gun; Yasuyoshi Hayakawa; Tsuyoshi Waragai, both of Mishima; Tomoyuki Araki, Numazu; Masayoshi Fukatsu, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/620,550

(22) Filed: Jul. 20, 2000

(30) Foreign Application Priority Data

Jul. 22, 1999 (JP) ..... 11-208168

(51) Int. Cl.[7] ..... B65H 31/04
(52) U.S. Cl. ..... 271/213; 271/214; 271/217
(58) Field of Search ..... 271/213, 214, 271/215, 217

(56) References Cited

U.S. PATENT DOCUMENTS

| | | | | |
|---|---|---|---|---|
| 5,155,537 | | 10/1992 | Komatsu et al. | 355/309 |
| 5,292,116 | | 3/1994 | Inoue et al. | 271/157 |
| 5,318,401 | * | 6/1994 | Mandel | 271/213 X |
| 5,348,284 | | 9/1994 | Ishihama et al. | 271/160 |
| 5,501,444 | | 3/1996 | Yukimachi et al. | 271/127 |
| 5,651,540 | | 7/1997 | Watanabe et al. | 271/10.12 |
| 5,931,460 | * | 8/1999 | Kadowaki et al. | 271/213 X |
| 6,145,826 | * | 11/2000 | Kawata | 271/213 X |
| 6,206,366 | * | 3/2001 | Schmid | 271/217 |

* cited by examiner

*Primary Examiner*—David H. Bollinger
(74) *Attorney, Agent, or Firm*—Fitzpatrick, Cella, Harper & Scinto

(57) ABSTRACT

A sheet stacking device including a stacking tray for stacking and containing sheets, and a lifting and lowering device for moving the staking tray up and down. In this case, the lifting and lowering device includes a driving force converting device for changing the distance of moving the stacking tray as an input and output ratio with respect to a predetermined driving force from a driving source, and changing the elevating speed of the stacking tray according to the input and output ratio. The driving force converting device includes a suspension member for suspending the stacking tray and a winding member having a conical winding portion for winging the suspension member, and lifts and lowers the stacking tray by rotating the winding member, and the elevating speed of the stacking tray is changed according to the winding length of the suspension member, which is changed depending on the diameter difference of the winding portion.

9 Claims, 7 Drawing Sheets

IMAGE FORMING APPARATUS AND SHEET STACKING DEVICE WITH LIFTER

BACKGROUND OF THE INVENTION

1. Field of the Invention

The present invention relates to a sheet stacking device capable of staking a great many sheets.

2. Related Background Art

Conventionally, a sheet stacking device connected to, or accompanying an image forming apparatus such as a copying machine or the like has needed a spacing for stacking sheets between a sheet ejecting port to the sheet stacking device and a stacking tray, which is set equal to or larger than a thickness of a bundle of sheets to be stacked.

In the case of the sheet stacking device capable of stacking a great many sheets, a large spacing needs to be formed from the sheet ejecting port to the stacking tray in order to secure a stacking capacity.

However, if there is a long distance from the sheet ejecting port to an actual sheet stacking position, the sheets fall by a long distance to the tray after ejection, resulting in the difficulty of maintaining high stacking alignment.

Thus, the stacking tray of such a sheet stacking device includes a mechanism moved up and down according to a stacking quantity.

Specifically, the stacking tray is located in an upper position when a stacking quantity is small, and a distance from the sheet ejecting port is set short. Then, by lowering the stacking tray as a sheet staking quantity is increased, control is performed such that a distance from the sheet ejecting port to a position for stacking sheets on the stacking tray can be substantially constant.

However, since the weight of the stacking tray is heavy while a great many sheets are stacked thereon, a great force needs to be provided for lifting/lowering the tray.

Accordingly, it is necessary to increase an output by using a large motor or torque by reducing an elevating speed.

If the large motor is used, the stacking tray can be lifted/lowered at a relatively high speed even when the number of sheets to be stacked is large. Compared with the case of using a small motor, however, motor costs, installation space, power consumption, and so on, are larger. Thus, it is difficult to provide an inexpensive and compact device.

If an elevating speed is reduced by using the small motor, moving time becomes very long, for example when the stacking tray in a lowest position is moved to a highest position, and the sheets cannot be fed to the stacking device during such a period. Consequently, work efficiency falls.

SUMMARY OF THE INVENTION

The present invention was made to solve the foregoing problems, and it is an object of the invention to provide a sheet stacking device capable of preventing a reduction in the work efficiency of a sheet stacking operation even if a small output motor is employed.

In order to achieve the above-described object, in accordance with an aspect of the invention, there is provided a sheet stacking device, comprising: stacking means for sacking and containing sheets; and lifting and lowering means for moving the stacking means up and down.

In this case, the lifting and lowering means includes driving force converting means for changing the distance of moving the stacking means as an input and output ratio with respect to a predetermined driving force entered from a driving source, and changing the elevating speed of the stacking means according to the input and output ratio.

Preferably, the driving force converting means may include a suspension member for suspending the sacking means, and a winding member having a conical winding portion for winding the suspension member, and lift/lower the stacking means by rotating the winding member. Then, the elevating speed of the stacking means is changed according to the winding length of the suspension member, which is changed depending on the diameter difference of the winding portion.

Preferably, the winding member may wind the suspension member by the small diameter side of the winding portion when the stacking means is located in a lower side, and wind the same by the large diameter side of the winding portion when the stacking means is located in an upper side.

Preferably, the driving force converting means may include a supporting member for supporting the stacking means by a spiral and pitch-changed cam face, and lift/lower the stacking means by rotating the supporting member. Then, the elevating speed of the stacking means may be changed according to the pitch length of the cam face of the supporting member.

Preferably, for the cam face of the supporting member, the pitch length of an abutting portion may be set small when the stacking means is located in a lower side, and large when the stacking means is located in an upper side.

Preferably, the driving force converting means may include a speed changing mechanism for changing and converting the rotation ratio of a rotary-driving force from the driving source, position detecting means for detecting the elevating position of the stacking means, and control means for controlling the speed changing mechanism according to the detected elevating position of the stacking means.

Preferably, the driving force converting means may include a speed changing mechanism for changing and converting the rotation ratio of a rotary-driving force from the driving source, sheet stacking amount detecting means for detecting the amount of sheets stacked on the stacking means, and control means for controlling the speed changing mechanism according to the detected sheet stacking amount.

Preferably, the driving force converting means may reduce a torque necessary for a rotary-driving force from the driving source by lifting/lowering the stacking means at a speed lower when a staking amount is large than a speed when a stacking amount is small, according to the amount of sheets stacked on the sheet stacking means.

In accordance with another aspect of the invention, there is provided an image forming apparatus, comprising: image forming means for forming an image on a sheet; and the sheet stacking device described above, wherein an image is formed by the image forming means, and an ejected sheet is stacked.

According to the above-described invention, a driving force necessary for the lifting/lowering operation of the sheet stacking means can be reduced without any reductions in the work efficiency of a sheet stacking operation. Thus, it is possible to employ a small output driving source, and to reduce the size of the driving source and the consumption of power.

DESCRIPTION OF THE PREFERRED EMBODIMENTS

First Embodiment

Figure 1:
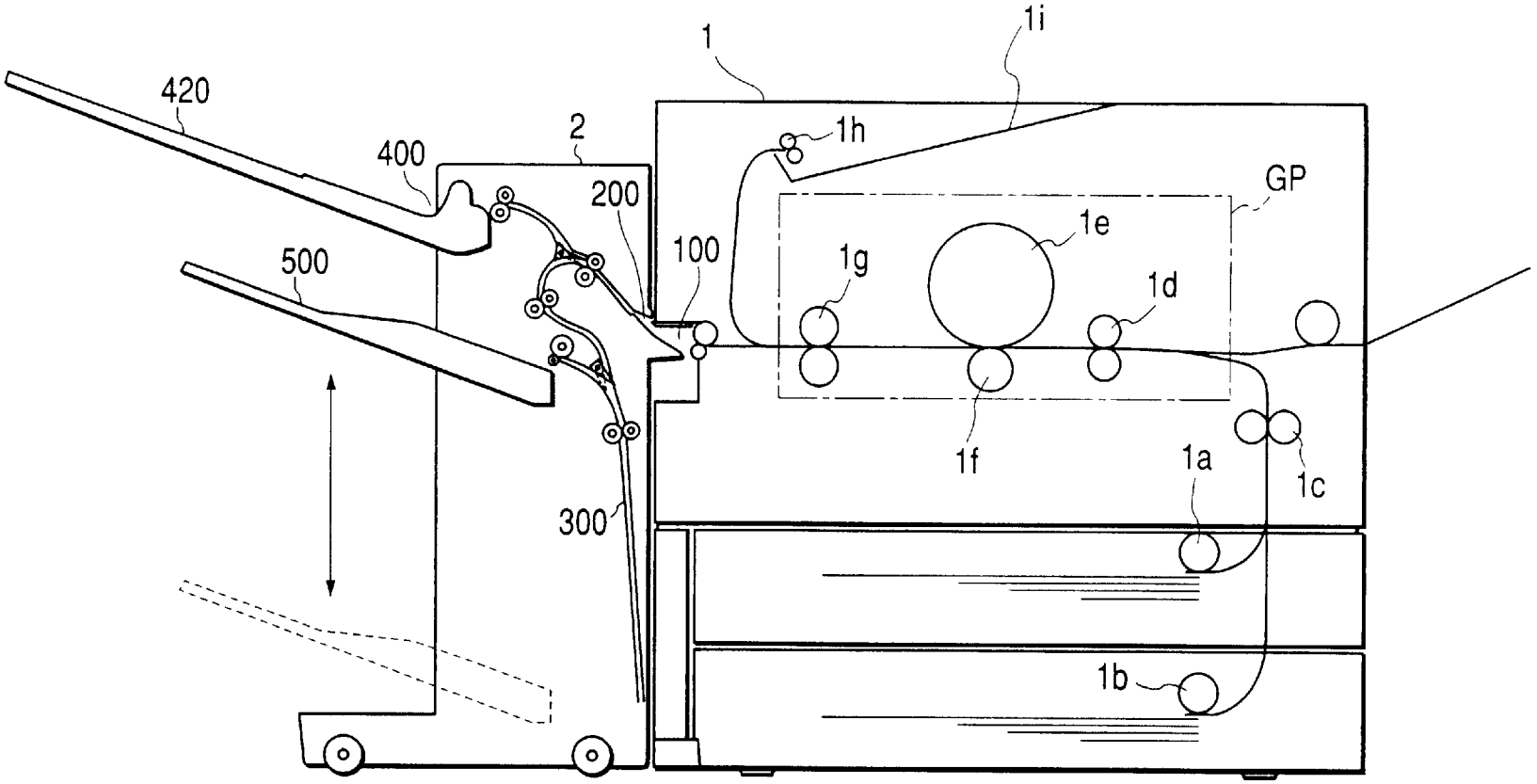
FIG. 1 is a sectional view illustrating a constitution of a sheet stacking device connected to an image forming apparatus.

Referring to FIG. 1, there is shown a sheet stacking device 2 of the present invention, which is connected to an image forming apparatus 1 in parallel with the same. In the image forming apparatus 1, a toner image is formed on the surface of a sheet by image forming means GP of a widely known electrophotographic system, and the sheet is ejected from an ejection port 100. In the drawing, reference numerals 1*a* and 1*b* denote pickup rollers for feeding sheets contained in cassettes; 1*c* denotes a conveying roller; 1*d* denotes a registration roller; 1*e* denotes a photosensitive drum; 1*f* denotes a transfer roller; 1*g* denotes a fixation roller; 1*h* denotes an ejection roller; and 1*i* denotes an ejection tray.

The sheet is ejected from the sheet ejection port 100 usually with its image face up. The sheet stacking device 2 is constructed to be capable of selecting, for example a mode for stacking the sheet with the image face up, or a mode for reversing the sheet ejected from the sheet ejection port 100 and stacking it with the image face down.

The connection of the sheet stacking device 2 having such a sheet reversing and conveying mechanism to the image forming apparatus 1 enables sheets to be stacked not in an order reverse to that of image formation, i.e., in the order of image formation, even if the sheets are sequentially ejected from the image forming apparatus 1.

Figure 2:
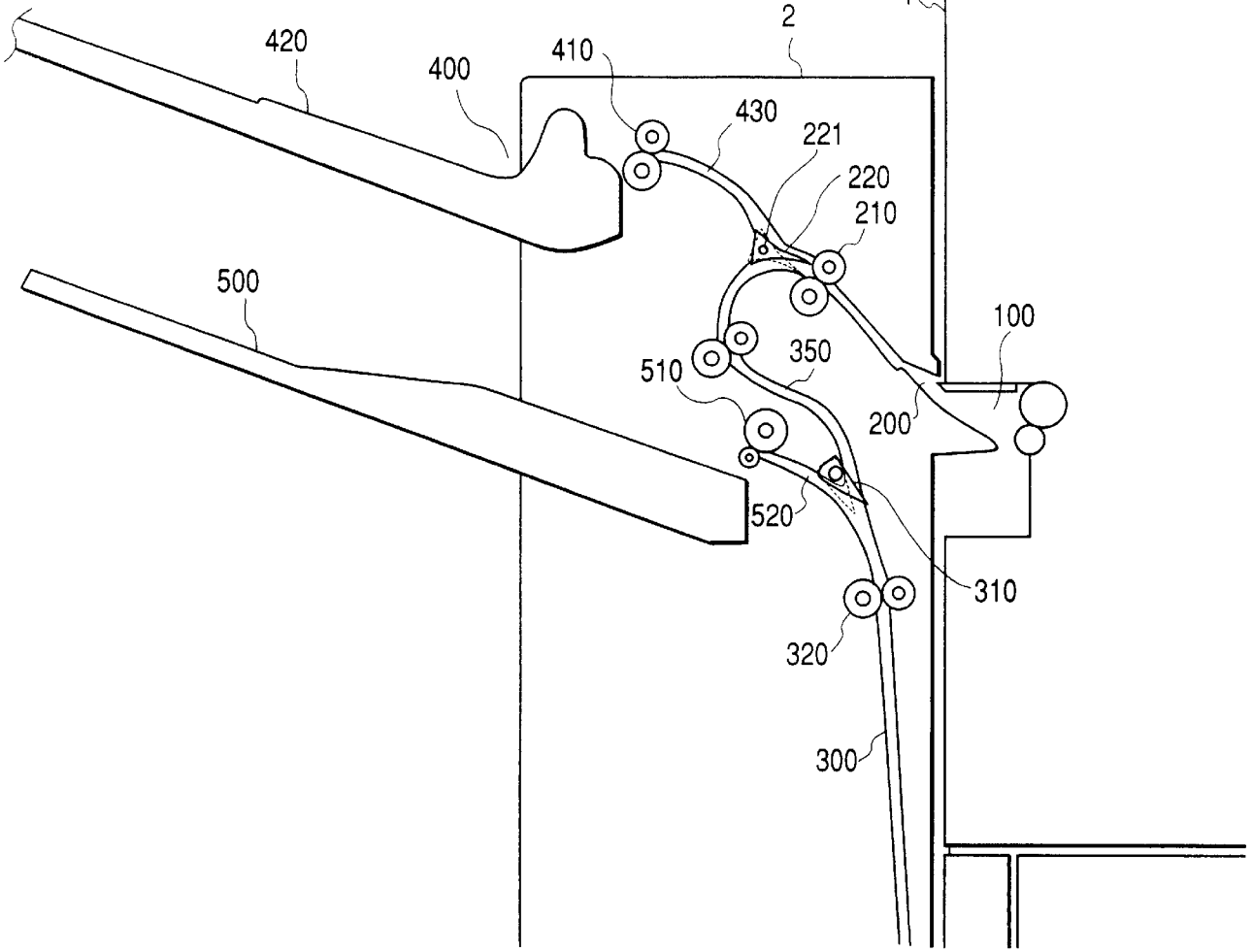
FIG. 2 is a sectional view illustrating a constitution of a sheet reversing portion of the sheet stacking device.

In FIGS. 1 and 2, a reference numeral 200 denotes a guiding member for receiving the sheet ejected from the sheet ejection port 100 of the image forming apparatus 1, and then guiding the sheet to a conveying-in roller 210 constantly rotated and operated as conveying-in and ejecting means.

A reference numeral 220 denotes an entry flapper disposed downstream of the conveying-in roller 210 and operated as conveying path switching means. This entry flapper 220 is rotated around a shaft 221 by not-shown actuator means, and selectively switched between positions indicated by solid and broken lines.

If the entry flapper 220 is switched to the position indicated by the solid line, the sheet is guided to a reverse portion 300. If it is switched to the position indicated by the broken line, the sheet is guided to a face-up ejection port 400 with its image face up without being reversed.

A reference numeral 410 denotes a discharge roller disposed at the face-up ejection port 400. By this discharge roller 410, the sheet is stacked on the face-up tray 410.

A reference numeral 310 denotes a reverse flapper provided in the entrance of the reverse portion 300 to prevent reverse feeding. The reverse flapper 310 is urged to be in a position indicated be the solid line by a spring. When the sheet is conveyed to the reverse portion 300, the reverse flapper 310 is pressed by the sheet to move to the position indicated by the broken line. After the passage of the trailing end of the sheet, however, the reverse flapper 310 is returned by a spring force again to the position indicated by the solid line, thereby preventing the reverse feeding of the sheet to the entrance portion.

A reference numeral 320 denotes a reverse roller for reversing a front surface and a back surface of a sheet. After the trailing end of the sheet passes the reverse flapper 310, this reverse roller 320 reverses a rotational direction and transfers the sheet to a discharge roller 510. In addition, the reverse roller 320 has a mechanism for releasing the pressure contact of the sheet, and enables the sheet and a succeeding sheet to brush against each other in the reverse portion.

A reference numeral 520 denotes a face-down conveying path for conveying the sheet to a stacking tray 500 as stacking means. The sheet is passed through the face-down conveying path 520, and delivered to the discharge roller 510. Then, by the discharge roller 510, the sheet is discharged to the staking tray 500, and stacked.

In this case, since the front and back surfaces of the sheet have been reversed in the reverse portion, an image surface faces downwardly, and the succeeding sheet is stacked on the sheet stacked with its image surface face down, similarly with the image surface thereof face down. Accordingly, the stacked sheets have been placed on the stacking tray 500 in the order of image formation.

Figure 3:
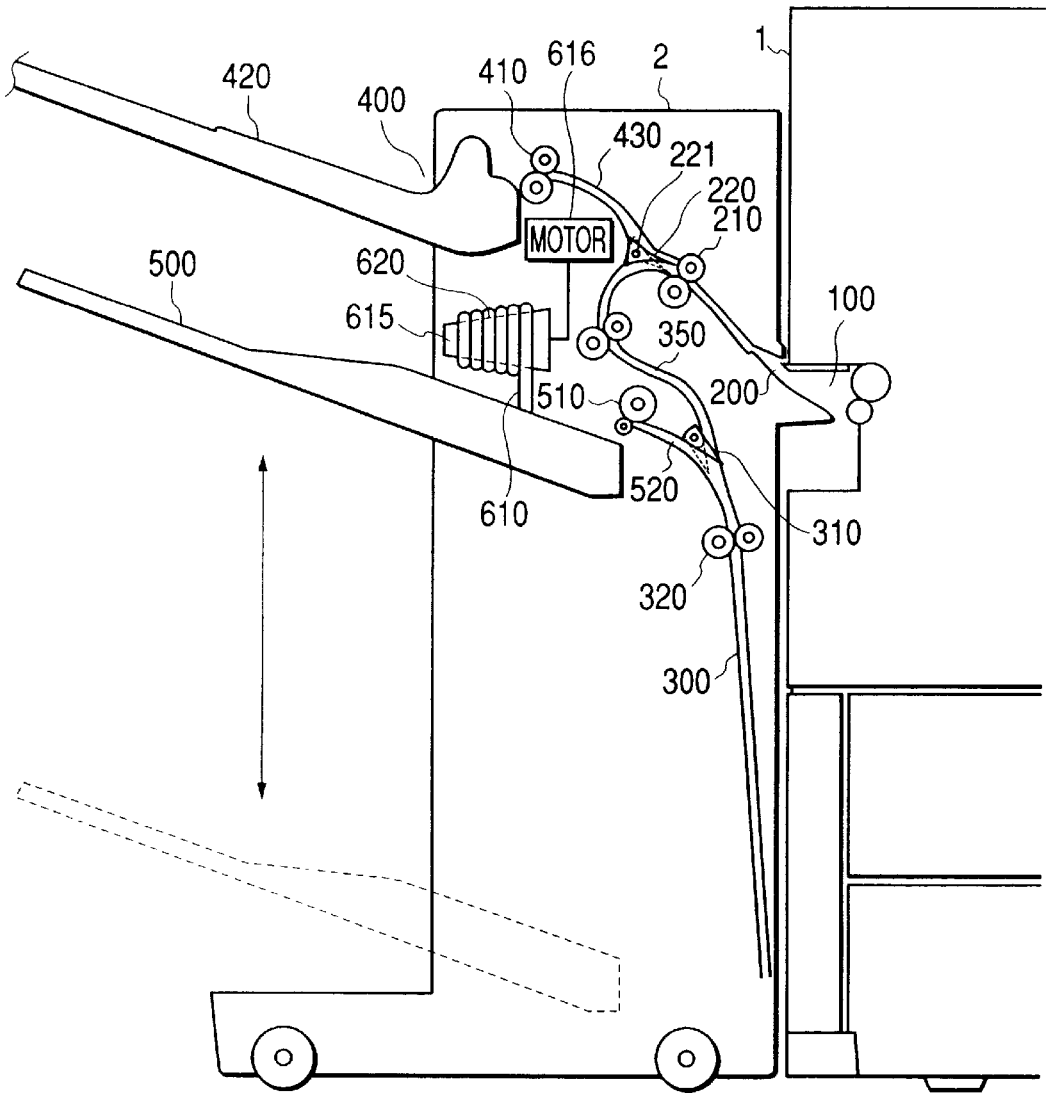
FIG. 3 is an explanatory view of lifting and lowering means of sheet stacking means according to a first embodiment.

As shown in FIG. 3, the stacking tray 500 can be moved up and down by lifting/lowering means according to the amount of stacked sheets.

Specifically, the stacking tray 500 is positioned in an upper side when the amount of stacked sheets is small, and in a lower side when the amount of stacked sheets is large. The distance of the sheets discharged by the discharge roller 510 falling to the stacking tray 500 can be maintained constant.

Therefore, the movement of the sheets after discharging is stabilized to improve sheet alignment, enabling a great many sheets to be stacked.

A reference numeral 610 denotes a wire provided as a suspension member for suspending the stacking tray 500. By winding the wire on a winding portion 620, i.e., the outer peripheral surface of a winding member 615 as driving force converting means, the position of the tray can be moved up and down. The winding member 615 receives a driving force from a driving source 616 (motor or the like), the winding portion 620 is conical in shape, and the wire 610 is wound on the winding portion 620 from the apex side of the conical shape.

When the stacking tray 500 is in a highest position, the wire 610 has been wound on the winding portion 620. By unwinding of the wire 610, the stacking tray 500 is lowered. In this case, the wire 610 is unwound first from a large-diameter side and gradually toward a small-diameter side.

Thus, even if the winding portion 620 is rotated at the same rotating speed by a rotary-driving force from the driving source, because of the diameter difference of the winding portion 620 in the axial direction, a lowering speed can be set fast when the stacking tray 500 is located in the upper side, and slow when the stacking tray 500 is located in the lower side. As a result, the distance of lifting/lowering the stacking tray 500 is changed as an input and output ratio with respect to a predetermined rotary-driving force entered from the driving source, and the elevating speed of the stacking tray 500 is changed according to the input and output ratio.

In other words, since the stacking amount is small and thus light in weight when the tray is in the upper side, the elevating speed is set fast because of the necessity of only small torque. Since the staking amount is large and thus heavy when the tray is in the lower side, the elevating speed is set slow to increase torque.

The inclination of the conical shape may be set such that a speed can be changed to maintain torque substantially constant against the weight of the stacked sheets.

Next, description will be made of the sheet conveying and staking operation of the sheet stacking device constructed in the foregoing manner.

First, after having received the sheet ejected from the sheet ejection port 100 of the image forming apparatus 1, the guiding member 200 guides the sheet to the conveying-in roller 210. Here, when the sheet is to be stacked without being reversed, the entry flapper 220 is switched to the position indicated by the broken line.

The sheet is passed through the face-up conveying path 430, and guided to the face-up ejection port 400 with its image surface face up. Then, the sheet is ejected out of the main body of the image forming apparatus 1 by the discharge roller 410, and staked on the face-up tray 420.

On the other hand, when the sheet is to be reversed and stacked, the entry flapper 220 is rotated around the shaft 221 by the actuator means to the position indicated by the solid line. The sheet having its image surface face up is guided through a surface reverse conveying path 350 to the reverse portion 300.

The sheet directed to the reverse portion 300 is pressure-contacted by the reverse roller 320, and the sheet is conveyed until the trailing end of the sheet passes the reverse flapper 310.

After the passage of the trailing end of the sheet through the reverse flapper 310, the reverse flapper 310 is returned to the position indicated by the solid line by a spring force. Thus, even if the sheet is fed reversibly thereafter, the sheet is prevented from entering the surface reverse conveying path 350.

When the sheet is conveyed into the sheet stacking device 2, the reverse roller 320 is in the state of releasing the pressure contact of the sheet, and the sheet is conveyed into a gap with the reverse roller 320. The reverse roller 320 starts pressure-contacting of the sheet before the trailing end of the sheet passes through the conveying-in roller 210.

After the passage of the trailing end of the sheet through the reverse flapper 310, the reverse roller 320 is rotated in a reverse rotational direction to convey the sheet in a reverse direction. Then, the sheet is guided to the face-down conveying path 520 by the reverse flapper 310.

When the sheet is pressure-contacted by the discharge roller 510, the reverse roller 320 releases the pressure contact of the sheet again. In this state, a succeeding sheet is enabled to enter the reverse roller 320, thus permitting two sheets to brush against each other in the reverse portion 300.

After the passage of the trailing end of the preceding sheet through the reverse roller 320, the pressure-contacting of the succeeding sheet is started, and a similar reversing operation is performed. Accordingly, the delay of the reversing operation can be reduced, and the reversing operation can be carried out without suspending the sheet conveying-in even if a space between the preceding sheet and the succeeding sheet is short.

The sheet guided to the face-down conveying path 520 is discharged to the stacking tray 500 by the discharge roller 510, and stacked thereon. If the sheet is not stacked on the stacking tray 500, the wire 610 is wound by the winding portion 620 as shown in FIG. 3, and the stacking tray 500 is located in the highest side of a movable range.

Figure 4:
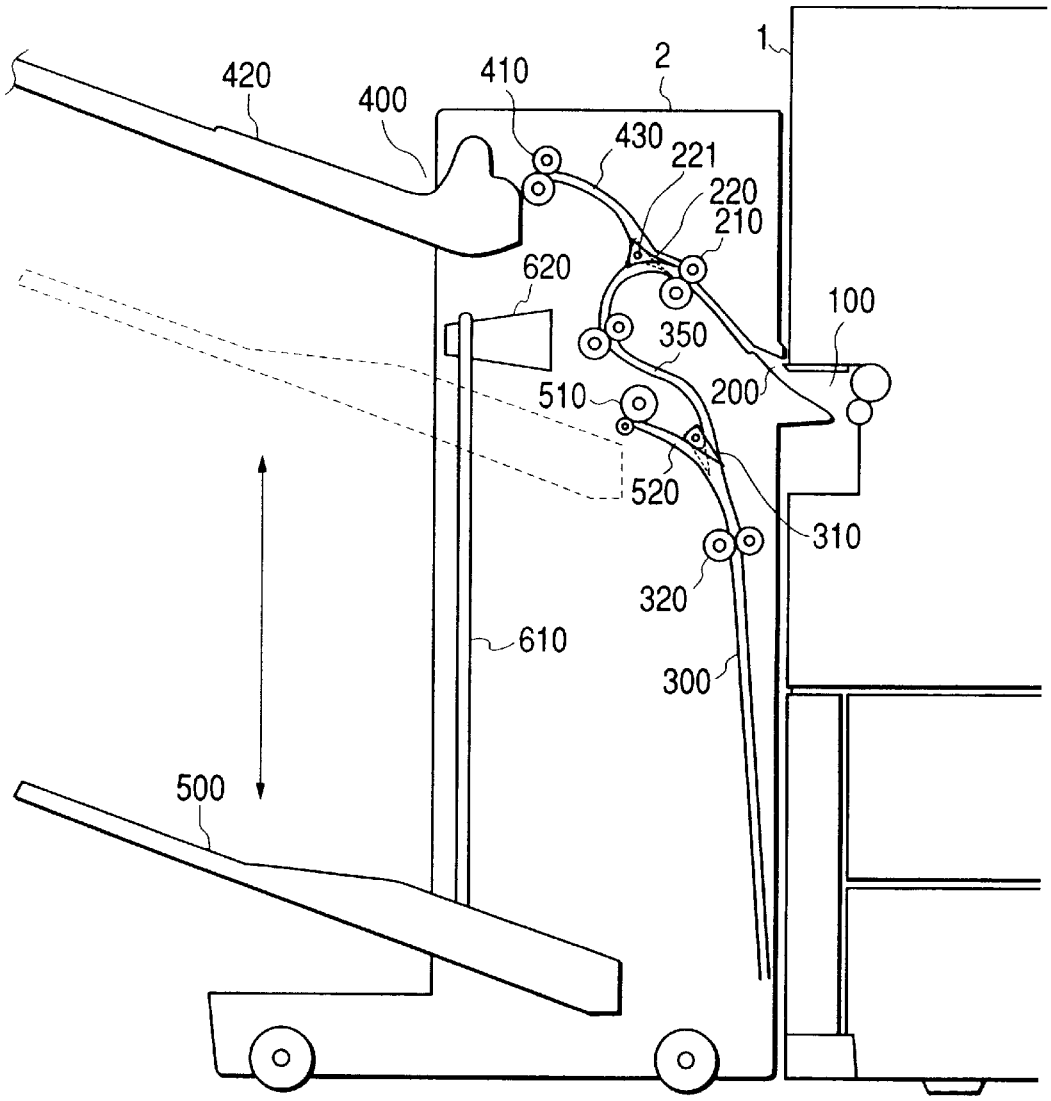
FIG. 4 is an explanatory view of the lifting and lowering means of the sheet stacking means of the first embodiment.

As the sheet is conveyed and stacked, as shown in FIG. 4, the winding portion 620 gradually unwinds the wire 610 to lower the stacking tray 500. In this way, the stacking tray 500 is controlled such that the distance of the discharged sheet from the discharge roller 510 to the position of the uppermost one of the stacked sheets can be maintained at a constant valve.

Toward the smaller diameter of the winding portion 620, the length of the wire 610 unwound through one revolution is shorter, and a falling speed is slower as the position of the tray is lower. Conversely, when the tray is lifted, the diameter of the winding portion 620 winding the wire 610 becomes gradually larger, and thus a rising speed is faster as the position of the tray is higher. Accordingly, even if a tray weight is increased due to the stacked sheets, fluctuation in load torque can be reduced.

Figure 7A:
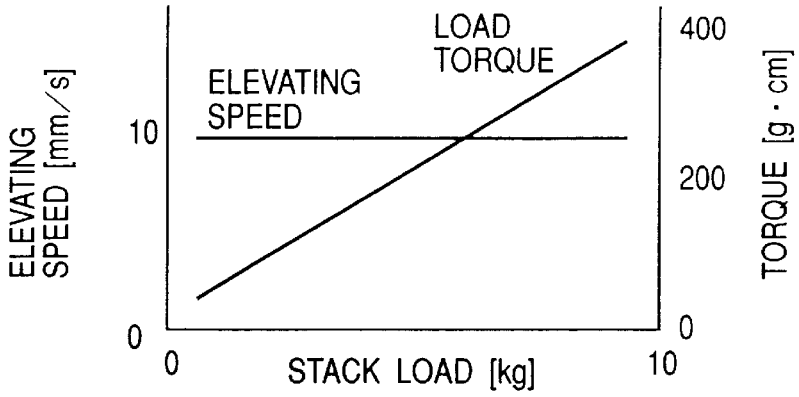
FIG. 7A is a graph showing a relation between an elevating speed and load torque according to a conventional art.
Figure 7B:
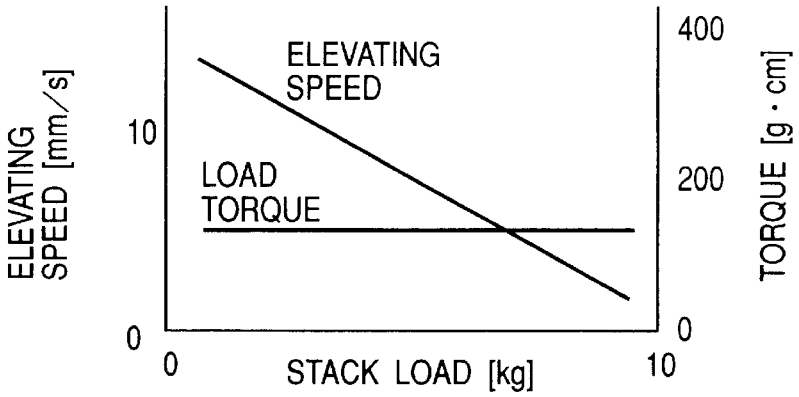
FIG. 7B is a graph showing a relation between an elevating speed and load torque according to the embodiment.

Referring to FIGS. 7A and 7B, there are graphically shown relations between elevating speeds and load torque. As shown in FIG. 7A, if no change occurs in an elevating speed, load torque necessary for winding the wire 610 is increased in proportion to a stack load. Accordingly, a large driving motor having an output to match load torque at the time of a maximum stack load needs to be installed.

However, as shown in FIG. 7B, by slowing down an elevating speed as a stack load is increased, a change in load torque necessary for winding the wire 610 is reduced. Thus, lifting/lowering can be performed efficiently by using a small motor.

When 2000 sheets of LETTER size are lifted/lowered, as shown in FIG. 7A, if the elevating speed is not changed, since elevating torque is increased in proportion to the stack load, a motor having an output of approximately 400 g·cm must be provided. On the other hand, as shown in FIG. 7B, by slowing down the elevating speed as the stack load is increased, lifting/lowering can be carried out by a motor having an output of approximately 150 g·cm. As a result, it is possible to lift/lower the tray efficiently by the small motor.

As described above with reference to FIGS. 7A and 7B, if the elevating speed is constant, the load torque of the driving source is increased in proportion to the sheet stacking load. Thus, in the conventional art, the motor having an output to match load torque necessary for lifting/lowering at the time of a maximum stack load was necessary. On the other hand, according to the embodiment, the elevating speed of the stacking tray 500 is changed by the winding portion 620, and thereby load torque necessary for lifting/lowering the stacking tray 500 can be reduced even if the stack load is increased.

Therefore, even if the sheet stacking amount is large and thus heavy, the stacking tray 500 can be lifted/lowered by using the small motor as a driving source.

In addition, by changing the elevating speed to lift/lower the tray at a speed faster as the position of the stacking tray 500 is higher, it is possible to shorten the moving time of the tray.

As a result, since the device can be operated without any reductions in work efficiency even the output of the motor is small, the motor can be miniaturized, and costs and power consumption can be reduced.

Second Embodiment

Figure 5:
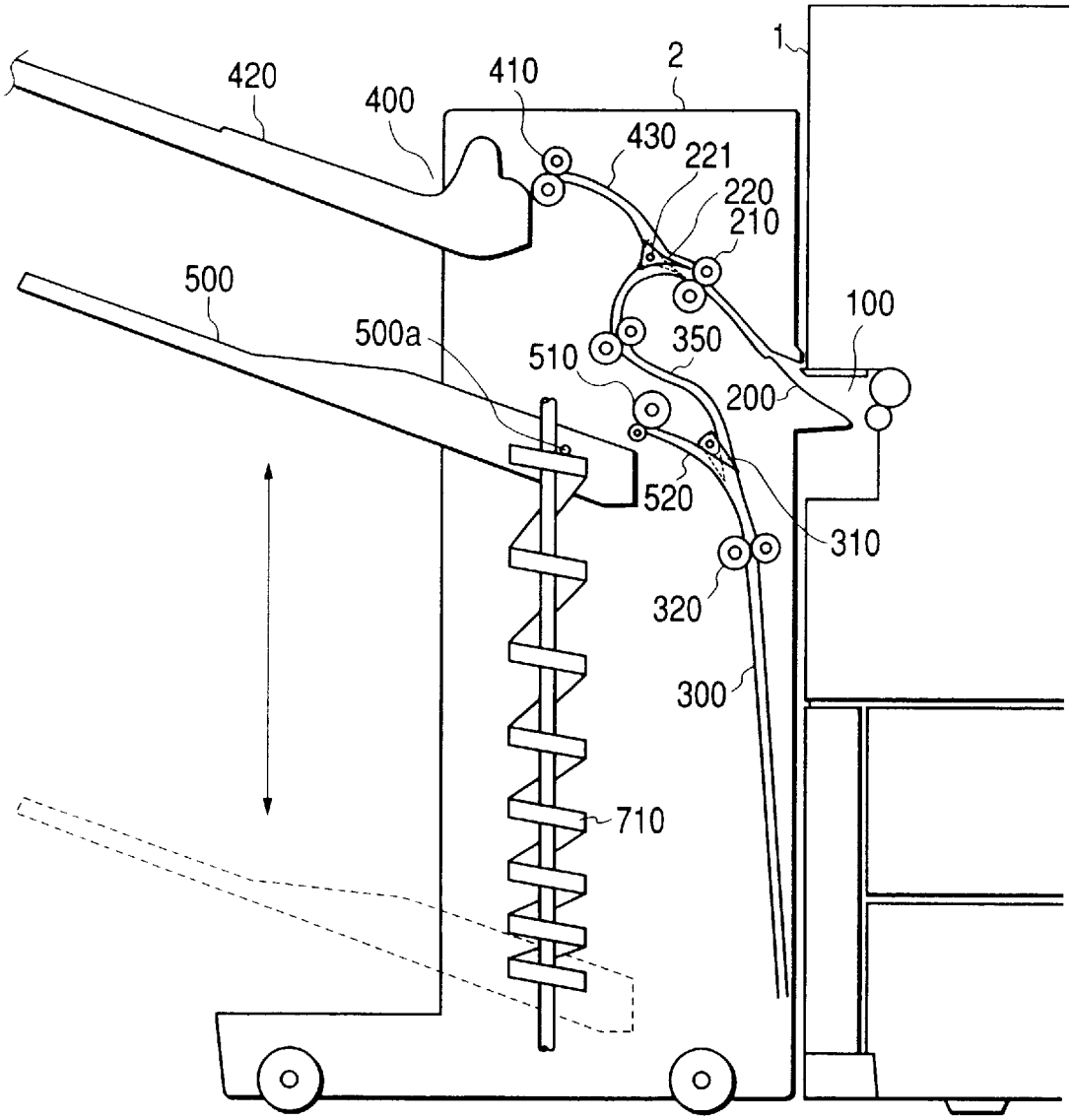
FIG. 5 is an explanatory view of the lifting and lowering means of sheet stacking means according to a second embodiment.

As shown in FIG. 5, for the lifting/lowering means of the stacking tray 500, a spiral cam as a supporting member can be used.

In FIG. 5, a reference numeral 710 denotes a spiral cam provided to lift/lower the stacking tray 500. The stacking tray 500 is supported by this spiral cam 710. The spiral cam 710 has a shape formed by spirally winding a cam face on a cylinder. The horizontal bar 500*a* of the stacking tray 500 is supported on this cam face, and the stacking tray 500 is then lifted/lowered.

In other words, the stacking tray 500 is moved up and down along the cam face by rotating the spiral cam 710.

In FIG. 5, the pitch length of the cam face supporting the stacking tray 500 is shorter in the lower portion of the spiral cam 710 and longer in the upper portion of the spiral cam 710. Accordingly, the elevating speed of the stacking tray 500 can be continuously changed.

Specifically, even if the rotational speed of the spiral cam 710 remains the same, the elevating speed is fast because of a long pitch when the stacking tray 500 is in an upper side, and slow because of a short pitch when the stacking tray 500 is in a lower side.

Therefore, an effect similar to that of the first embodiment can be obtained. Moreover, since the stacking tray 500 is supported by the spiral cam 710, the lifting/lowering operation can be more stable than that when it is suspended by a wire.

Third Embodiment

Figure 6:
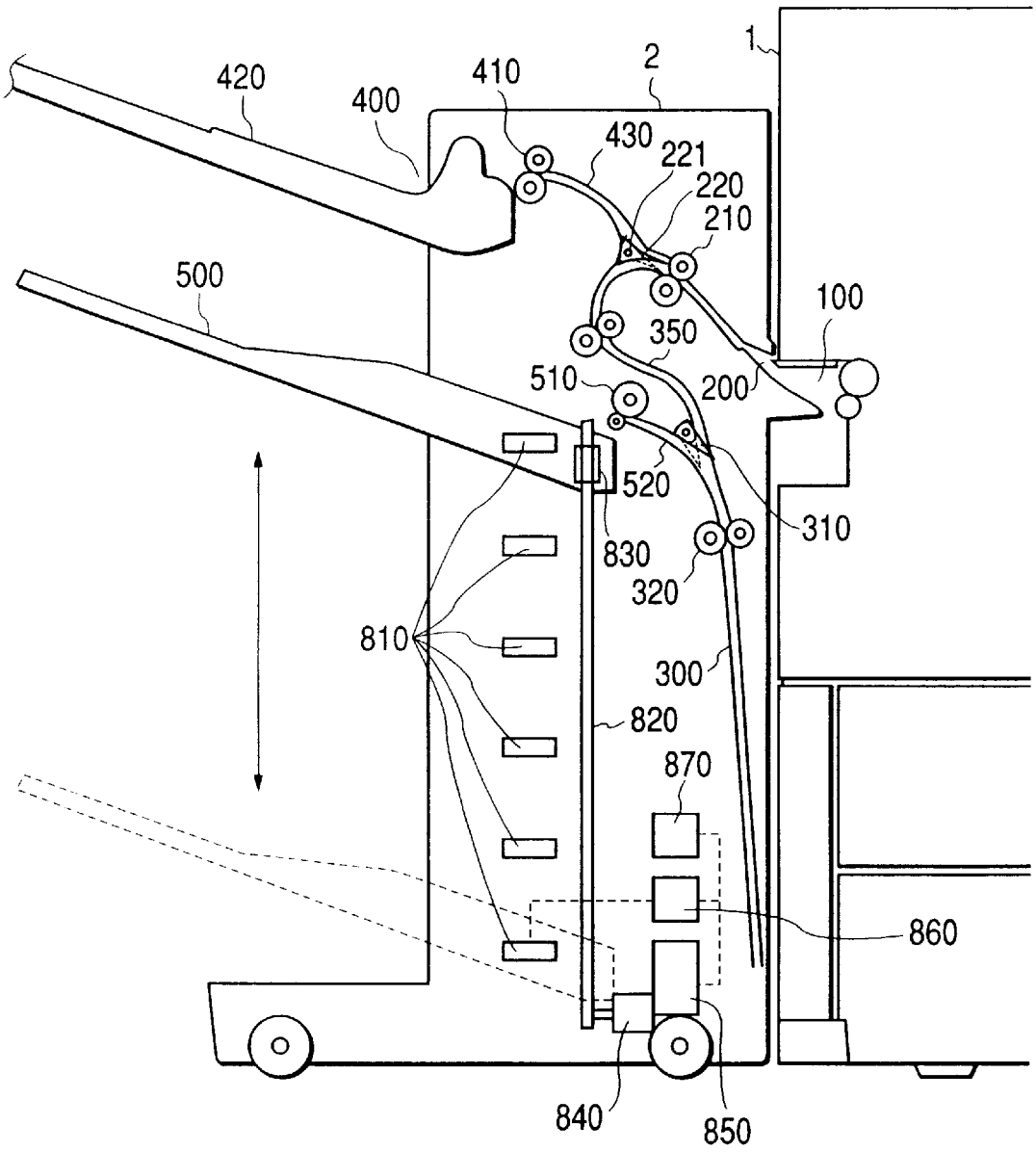
FIG. 6 is an explanatory view of the lifting and lowering means of sheet stacking means according to a third embodiment.

In FIG. 6, a reference numeral 810 denotes sensors serving as position detecting means, which are installed in a plurality of places along the elevation path of the stacking tray 500 to detect the position of the stacking tray 500. The stacking tray 500 is connected with a nut 830 engaged with a screw shaft 820, and lifted/lowered by the rotation of the screw shaft 820 following the up-and-down movement of a nut 830.

The rotary-driving of the screw shaft 820 is carried out by a driving device 850 (motor or the like) having a speed changing mechanism 840.

For the speed changing mechanism 840, one changing a change gear ratio by selectively using a plurality of gear trains, or one moving the axial position of a belt with respect to a conical pulley maybe used.

When the position of the stacking tray 500 is detected by the sensor 810, the change gear ratio of the speed changing mechanism 840 is changed to a speed according to the detected position by control means 860, to which the output of the sensor 810 is inputted, and the driving device 850 is controlled to change the elevating speed of the stacking tray 500.

In other words, by the control means 860, for example the elevating speed is set faster when the position of the stacking tray 500 is higher, and slower when the position of the stacking tray 500 is lower.

Figure 8:
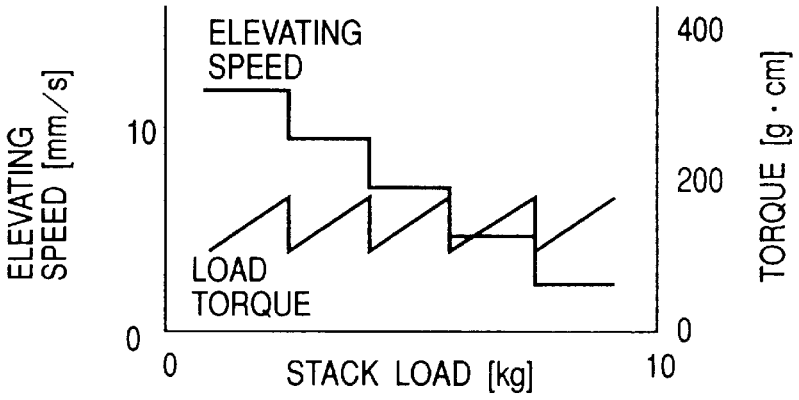
FIG. 8 is a graph showing a relation between an elevating speed and load torque according to the third embodiment.

Therefore, if the change gear ratio of the speed changing mechanism 840 is set in staircase pattern, the elevating speed is changed step wise like that shown in FIG. 8. Torque at this time fluctuates in a serrated shape like that shown in FIG. 8 and, compared with the case of no change in the elevating speed, the torque can be reduced.

Apparently, even when the elevating speed is smoothly changed by using a variable speed changing mechanism, necessary torque can be reduced, and torque fluctuation can be suppressed more.

Such a speed changing mechanism 840 enables the elevating speed of the stacking tray 500 to be optionally set. For example, when there is a difference in stacking weight due to a difference in size among sheets even if the position of the stacking tray 500 is the same, it is possible to properly set the elevating speed by detecting the sheet size or the stacking weight itself.

Another possible way of setting an elevating speed of the stacking tray 500 is that for elevating torque detecting means 870, a torque detecting sensor or a current value detecting circuit of the driving device 850 is provided, and control is performed for the driving device 850 associatively with the control means 860 so as to reduce elevating torque.

Furthermore, the stacking tray 500 may be provided with means for detecting the presence of a sheet on the tray, and when no sheets are present on the stacking tray 500, a fast elevating speed may be set irrespective of the position of the stacking tray 500.

What is claimed is:

1. A sheet stacking device comprising:

stacking means for stacking and containing sheets; and lifting and lowering means for moving the stacking means up and down, wherein said lifting and lowering means includes driving force converting means for changing a distance of moving the stacking means as an input and output ratio with respect to a predetermined driving force inputted from a driving source, and changing an elevating speed of the stacking means in accordance with the input and output ratio.

2. A sheet stacking device according to claim 1, wherein said driving force converting means includes a suspension member for suspending the stacking means and a winding member having a conical winding portion for winding the suspension member, and lifts and lowers the stacking means by rotating the winding member, and wherein the elevating speed of the stacking means is changed in accordance with a winding length of the suspension member, which is changed depending on a diameter difference of the winding portion.

3. A sheet stacking device according to claim 2, wherein said winding member winds the suspension member by a small diameter side of the winding portion when the stacking means is located in a lower side, and winds the suspension member by a large diameter side of the winding portion when the stacking means is located in an upper side.

4. A sheet stacking device according to claim 1, wherein said driving force converting means includes a supporting member for supporting the stacking means by a spiral and pitch-changed cam face, and lifts and lowers the stacking means by rotating the supporting member, and the elevating speed of the stacking means is changed in accordance with a pitch length of the cam face of the supporting member.

5. A sheet stacking device according to claim 4, wherein the cam face of the supporting member is formed so that a pitch length of a portion abutting against the stacking means when the stacking means is located in a lower side is set small, and a pitch length of a portion abutting against the stacking means when the stacking means is located in an upper side is set large.

6. A sheet stacking device according to claim 1, wherein said driving force converting means includes a speed changing mechanism for changing and converting a rotation ratio of a rotary-driving force from the driving source, position detecting means for detecting an elevating position of the stacking means, and control means for controlling the speed changing mechanism in accordance with a the detected elevating position of the stacking means.

7. A sheet stacking device according to claim 1, wherein said driving force converting means includes a speed changing mechanism for changing and converting a rotation ratio of a rotary-driving force from the driving source, sheet stacking amount detecting means for detecting an amount of sheets stacked on the stacking means, and control means for controlling the speed changing mechanism in accordance with a detected sheet stacking amount.

8. A sheet stacking device according to claim 7, wherein the driving force converting means lifts and lowers the sheet stacking means at a speed lower when a stacking amount is large than a speed when a stacking amount is small in accordance with the amount of sheets stacked on the stacking means.

9. An image forming apparatus comprising:

image forming means for forming an image on a sheet; and a sheet stacking device according to any one of claims 1 to 8, for stacking a discharged sheet on which an image in formed by the image forming means.

* * * * *

UNITED STATES PATENT AND TRADEMARK OFFICE

CERTIFICATE OF CORRECTION

PATENT NO. : 6,318,718 B1
DATED : November 20, 2001
INVENTOR(S) : Atsushi Ogata et al.

It is certified that error appears in the above-identified patent and that said Letters Patent is hereby corrected as shown below:

Title page,
Item [57], line 12, "winging" should read -- winding --.

Column 1,
Line 39, "by" should read -- thereby --
Line 61, "sack-" should read -- stack- --.

Column 2,
Line 4, "sacking" should read -- stacking --.
Line 47, "staking" should read -- stacking --.

Column 4,
Line 3, "tray 410." should read -- tray 420. --.
Line 29, "staking" should read -- stacking --.

Column 5,
Line 14, "staking" should read -- stacking --.
Line 21, "staking" should read -- stacking --.

Column 7,
Line 55, "maybe" should read -- may be -- .

Column 10,
Line 11, "the" should be deleted.
Line 15, "in" should read -- is --.

Signed and Sealed this

Nineteenth Day of March, 2002

*Attest:*

*Attesting Officer*

JAMES E. ROGAN
*Director of the United States Patent and Trademark Office*